US006938514B1

(12) United States Patent
Crane et al.

(10) Patent No.: US 6,938,514 B1
(45) Date of Patent: Sep. 6, 2005

(54) CONNECTOR ASSEMBLY FOR MOUNTING AN IMPLEMENT TO A PRIME MOVER

(75) Inventors: Jeffery L. Crane, Mantua, OH (US); Danny Grznar, Ravenna, OH (US)

(73) Assignee: Kent Demolition, Inc., Kent, OH (US)

( * ) Notice: Subject to any disclaimer, the term of this patent is extended or adjusted under 35 U.S.C. 154(b) by 195 days.

(21) Appl. No.: 10/219,593

(22) Filed: Aug. 15, 2002

Related U.S. Application Data

(63) Continuation-in-part of application No. 10/047,278, filed on Jan. 14, 2002, now Pat. No. 6,662,681.

(51) Int. Cl.[7] ..... G05G 1/00; E02F 3/40

(52) U.S. Cl. ..... 74/571 M; 37/444; 384/255; 74/570; 403/4; 248/200

(58) Field of Search ..... 74/571 M, 570; 37/444, 407, 443; 384/255; 403/4; 248/200; 29/426.5; 414/685

(56) References Cited

U.S. PATENT DOCUMENTS

| | | | | |
|---|---|---|---|---|
| 1,565,264 A | | 12/1925 | Dubi | 37/44 |
| 1,571,557 A | | 2/1926 | Paul | 37/44 |
| 2,159,348 A | | 5/1939 | Austin | 37/44 |
| 2,859,058 A | | 11/1958 | Traugott | 287/53 |
| 3,985,249 A | | 10/1976 | Aker et al. | 214/145 |
| 4,106,876 A | | 8/1978 | Tregoning | 403/4 |
| 4,133,121 A | | 1/1979 | Hemphill | 37/118 |
| 4,207,693 A | | 6/1980 | Hemphill | 37/195 |
| 4,235,567 A | | 11/1980 | Pilch | |
| 4,360,980 A | | 11/1982 | Jarvis | 37/117.5 |
| 4,446,753 A | | 5/1984 | Nagano | 74/594 |
| 4,592,696 A | * | 6/1986 | Carternock | 414/685 |
| 4,670,983 A | | 6/1987 | Ramun et al. | 30/134 |
| 4,813,163 A | | 3/1989 | Livingston et al. | 37/103 |
| 4,836,741 A | | 6/1989 | St. Louis et al. | 414/723 |
| 4,871,292 A | | 10/1989 | Milanowski | 414/723 |
| 4,955,779 A | | 9/1990 | Knackstedt | 414/723 |
| 4,984,639 A | | 1/1991 | Lindsey et al. | 173/100 |
| 5,172,498 A | * | 12/1992 | Wack | 37/443 |
| 5,305,661 A | | 4/1994 | Schartman et al. | 74/571 |
| 5,382,110 A | | 1/1995 | Perotto et al. | 403/322 |
| 5,398,396 A | * | 3/1995 | Sanders et al. | 29/426.5 |
| 5,431,528 A | | 7/1995 | Jenkins et al. | 414/723 |
| 5,487,230 A | | 1/1996 | Weyer | 37/468 |

(Continued)

FOREIGN PATENT DOCUMENTS

| | | | |
|---|---|---|---|
| FR | 2 753 337 | 3/1998 | 74/571 M |

(Continued)

*Primary Examiner*—Vinh T. Luong
(74) *Attorney, Agent, or Firm*—Renner, Kenner, Greive, Bobak, Taylor & Weber

(57) ABSTRACT

A connector assembly for attaching an implement to a prime mover having spaced connecting pins, the connector assembly including a pair of spaced plates, each of the plates carrying a first receiver to receive a first of the connecting pins and a second receiver adapted to receive the second of the connecting pins, wherein at least one of the first and second receivers is an adjustable receiver rotatable about an axis and having a transverse bore spaced radially from the axis and rotatable relative thereto, whereby rotation of the adaptable receiver about the axis changes the relative spacing between the first and second pin receiver.

7 Claims, 10 Drawing Sheets

U.S. PATENT DOCUMENTS

| | | | | |
|---|---|---|---|---|
| 5,549,440 | A | 8/1996 | Cholakon et al. | 414/723 |
| 5,596,825 | A * | 1/1997 | Von Schalscha | 37/407 |
| 5,722,674 | A | 3/1998 | Dawson | 280/149.2 |
| 5,915,837 | A | 6/1999 | Brown et al. | 37/468 |
| 5,927,665 | A | 7/1999 | Grabnic | 248/200 |
| 5,975,604 | A | 11/1999 | Wolin et al. | 294/88 |
| 5,983,535 | A | 11/1999 | Kaczmarski et al. | 37/468 |
| 6,163,989 | A | 12/2000 | Kaczmarski et al. | 37/468 |
| 6,170,178 | B1 | 1/2001 | Christy | 37/231 |
| 6,241,455 | B1 | 6/2001 | Schupback et al. | 414/723 |
| 6,301,811 | B1 | 10/2001 | Gilmore, Jr. | 37/468 |
| 6,364,561 | B1 | 4/2002 | Droegemueller | 403/4 |
| 6,370,801 | B1 | 4/2002 | Weyer et al. | 37/406 |
| 6,379,075 | B1 | 4/2002 | Shamblin et al. | 403/322.1 |
| 2002/0021960 | A1 | 2/2002 | Waggoner | |

FOREIGN PATENT DOCUMENTS

| | | | |
|---|---|---|---|
| WO | WO 99/06317 | 2/1999 | B66C 23/62 |
| WO | WO 00/61485 | 10/2000 | B66C 3/16 |
| WO | WO01/83894 | 11/2001 | 23/26 |

* cited by examiner

CONNECTOR ASSEMBLY FOR MOUNTING AN IMPLEMENT TO A PRIME MOVER

RELATED APPLICATIONS

This application is a continuation-in-part of U.S. patent application Ser. No. 10/047,278, filed Jan. 14, 2002 now U.S. Pat. No. 6,662,681.

TECHNICAL FIELD

In general, the present invention relates to the mounting of implements to a prime mover. More particularly, the present invention relates to a connector assembly that provides adjustment for variations in the mounting pin locations, as dictated by individual implement and prime mover manufacturers. Most particularly, the present invention relates to a connector assembly having a rotating pin receiver that provides multiple pin spacings along a circumferential path.

BACKGROUND OF THE INVENTION

Earthmoving and demolition equipment, such as excavators and backhoes are typically referred to as prime movers in the art, and include a variety of attachments for performing a desired task. Some of the attachments commonly used include, among others, a bucket, hydraulic hammer, or tamper,m collectively referred to herein as implements. The prime mover and implement are typically attached by a pair of spaced mounting pins. It has become a common practice among manufacturers of prime movers to provide unique pin spacings for their prime mover and implements, such that users are encouraged to buy both the prime mover and implement from the same manufacturer.

As will be appreciated, this practice limits the user's ability to use implements purchased for other prime movers and custom implements from independent manufacturers. In the past, to use implements from a different manufacturer, users have attempted to machine implements for a particular pin spacing. As will be appreciated, this process is costly and independent manufacturers are forced to machine separate implements for each manufacturer.

Recently, one manufacturer has attempted to construct a coupler that will accommodate multiple pin spacings. In a fashion typical in the art, the coupler has a pair of spaced plates with aligned apertures at the front and rear of the plates that receive a mounting pin. To provide multiple pin spacings, slot-like apertures are formed in the plates and adapted to receive adaptor plugs that define a bore corresponding to a selected pin spacing. Each bore is formed at a position corresponding to a manufacturer. Thus, to adjust the pin position for an individual manufacturer, an adaptor plug carrying a bore at the desired spacing is inserted into the slot, and the pins are passed through the boom of the prime mover and the coupler. To provide for multiple spacings, multiple adapter plugs must be used, thus, when using multiple implements from a variety of manufacturers, the prime mover owner must carry multiple adaptor plugs. As will be appreciated, carrying multiple plugs may be an inconvenience and those plugs that are not in use may be prone to less or misplacement, such that, the user may not have the proper adapters, when they are needed.

SUMMARY OF THE INVENTION

It is an object of the present invention to provide a connector assembly for connecting an implement to a prime mover that adapts to provide multiple pin spacings necessitated by various manufacturers. It is a further object of the present invention to provide a pin receiver having a pin receiving bore carried thereon that rotates eccentrically, to provide multiple spacings relative to the other pin receiver on the connector. Still a further object of the present invention is to provide a connector assembly having a pair of spaced upstanding plates, defining a first pin receiver and a second pin receiver having a hub rotatably mounted on the plate carrying a pin receiving bore that rotates about the center of the hub to provide multiple spacings relative to the first pin receivers.

It is another object of the present invention to provide a connector assembly having a rotatable pin receiver that includes a locking assembly, such that, the rotatable pin receiver may be indexed and locked in a selected position corresponding to a selected spacing between the pin receivers on a side plate. A further object of the present invention is to provide a plurality of locking assembly receivers formed on either the rotatable pin receiver or the plate opposite the locking assembly, such that, the rotatable pin receiver may be indexed to a plurality of selected positions corresponding to the desired pin spacings.

In light of at least one of these objects, the present invention generally provides a connector assembly for attaching an implement to a prime mover having spaced mounting pins, the connector assembly including a pair of spaced plates, each of the plates carrying a first receiver defining a transverse bore adapted to receive a first of the mounting pins and a second receiver adapted to receive the second of the mounting pins, wherein at least one of the first and second receivers is an adjustable receiver rotatable about an axis and having the transverse bore spaced radially from the axis and rotatable relative thereto, whereby rotation of the adaptable receiver about the axis changes the relative spacing between the first and second pin receiving bores.

The present invention further provides a connector assembly for coupling an implement to a prime mover by way of first and second connecting pins, the connector assembly comprising a first receiver adapted to receive one of the connecting pins and a second receiver adapted to receive the other of the connecting pins, wherein the first receiver is rotatable eccentrically about an axis, and a locking assembly adapted to hold said first receiver in a selected spacing relative to the second receiver, the locking assembly including at least one tooth engageable with a stop surface to fix the first receiver in the selected spacing.

DETAILED DESCRIPTION OF THE INVENTION

Figure 7:
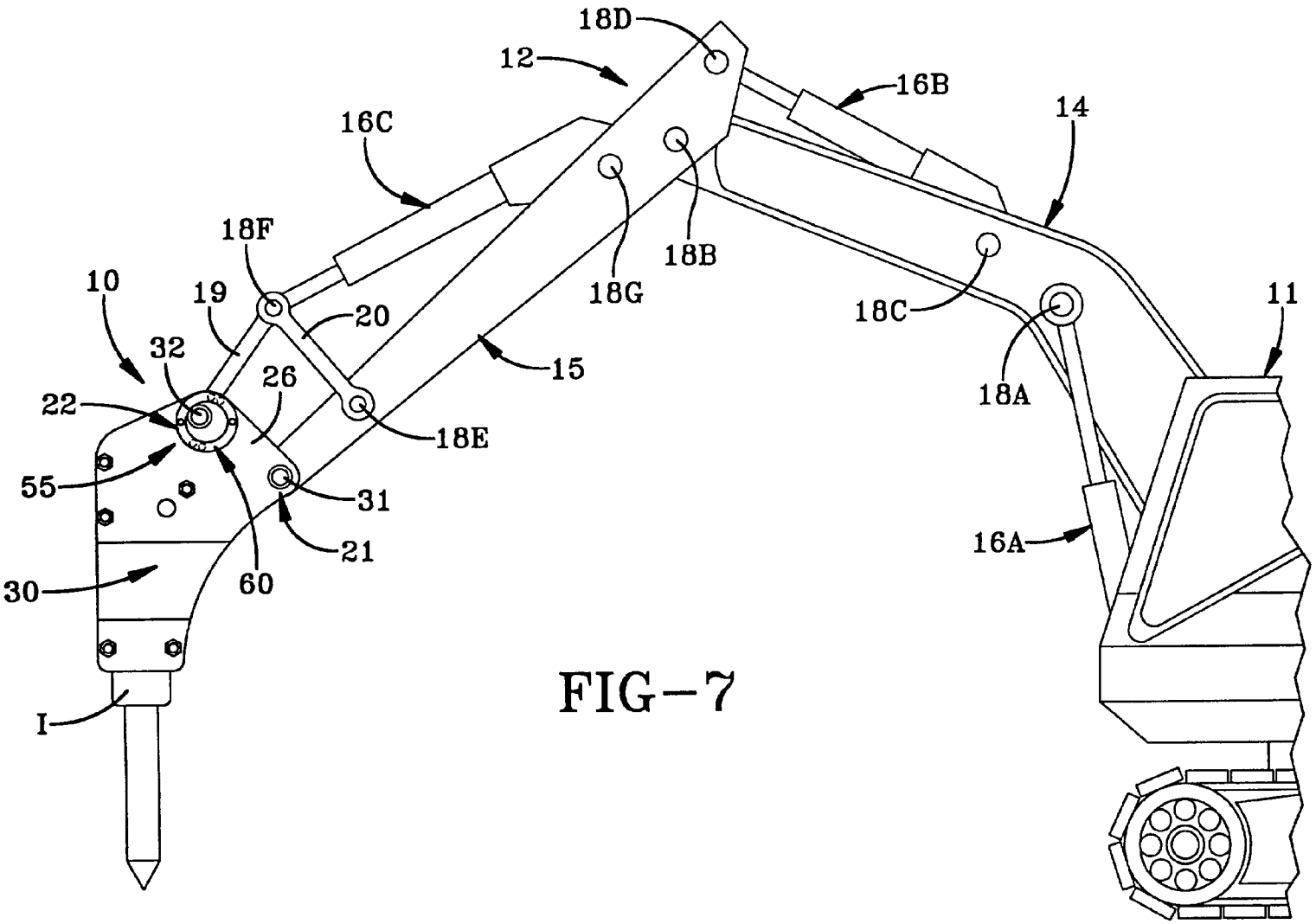
FIG. 7 is a partially schematic, partially fragmented side elevational view of an implement attached to a prime mover by a connector according to the present invention.

A connector assembly, embodying the concepts of the present invention is generally indicated by the numeral 10, in the accompanying Figures. With reference to FIG. 7, connector assembly 10 is used in connection with a prime mover 11 to secure a work implement I, such as the hydraulic hammer depicted, to an articulating boom 12 on the prime mover 11. The articulating boom 12 may include proximal and distal boom arms 14, 15 with the proximal boom arm 14 being pivotally attached to the prime mover 11, in a manner well known in the art. The proximal boom 14 arm may be raised and lowered about the inboard end thereof by piston/cylinder arrangement 16A that is pivotally connected between the prime mover 11 and a pivot pin 18A that may extend transversely through the proximal boom arm 14. The inboard end portion of the distal boom arm 15 is mounted to the outboard end and the proximal boom arm for articulation about the pivot pin 18B. Articulation of the distal boom arm 12 may be selectively controlled by a piston/cylinder arrangement 16B. Specifically, one end of the piston/cylinder arrangement is pivotally supported from the proximal boom arm 14, as by a pivot pin 18C, and the other end of the piston/cylinder arrangement is secured to a pivot pin 18D that extends transversely through the lever arm portion of the distal boom arm 15 at the inboard end thereof. Thus, there are at least two piston/cylinder arrangements 16 associated with the articulating boom 12. The articulating arm 19 is operatively associated with the distal boom arm 15 to effect pivotal movement of the connector assembly 10 about the outboard end of the distal boom arm 15. Specifically, the inboard end of a tie rod 20 is pivotally supported on a pivot pin 18E that extends through the distal boom arm 15, and the outboard end of the tie rod 20 is pivotally connected not only to the piston/cylinder arrangement 16C but also to the inboard end of the articulating arm 19, as by a pivot pin 18F. The other end of the piston/cylinder arrangement 16C is anchored to the inboard end portion of the distal boom arm 15 at pivot pin 18G, in combination with the tie rod 20, to effect selective pivotal movement of the connector assembly 10 by relative movement of the articulating arm 19 with respect to the distal boom arm 20.

The connector assembly 10 is secured to the outboard end of the distal boom arm 15 by a first connecting pin receiving assembly 21 and to the articulating arm 19 by a second connecting pin receiving assembly 22. Thus, the connector assembly 10 which is secured to the articulating boom provides an operative connection for demountably attaching the implement I thereto, and the articulating boom 12 is, in turn, operatively mounted to the prime mover 11.

Figure 1:
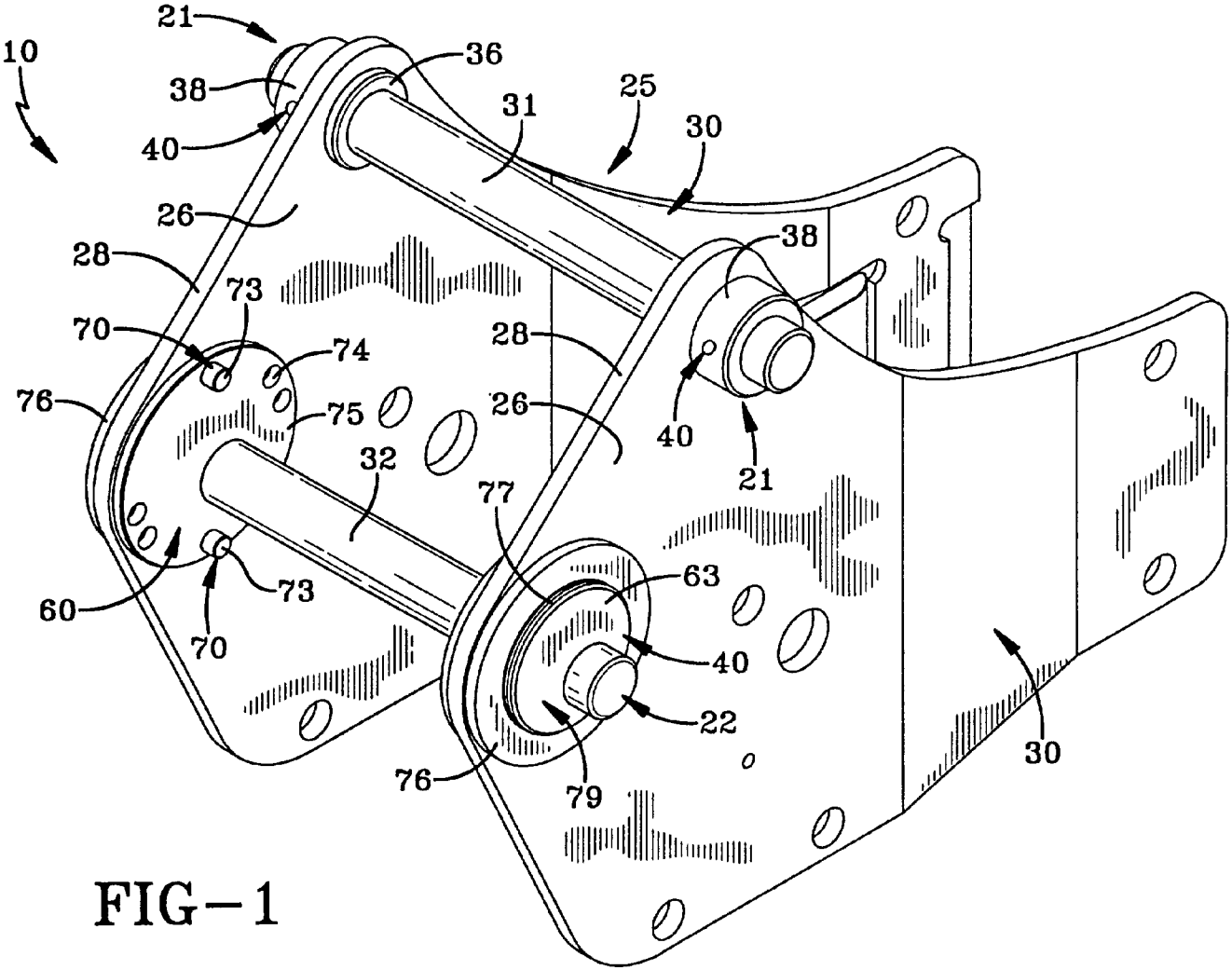
FIG. 1 is a perspective view of a connector assembly according to the present invention depicting a pair of spaced plates supporting first and second mounting pin receivers shown with the mounting pins located therein, where one of the receivers is an adjustable receiver rotatable to a selected pin spacing, and a lock assembly for maintaining the adjustable receiver in the selected spacing position.

With reference to FIG. 1, the connector assembly 10 includes a main body, generally indicated by the numeral 25, having a pair of laterally spaced side plates 26 formed integrally or attached to the implement I. As shown, side plates 26 may be oriented in parallel relation to each other. Side plates 26 may be of generally any form or profile, as dictated by the implement I. Further side plates 26 may be contoured to facilitate operational movement of the implement I or articulating arm 19.

Figure 2:
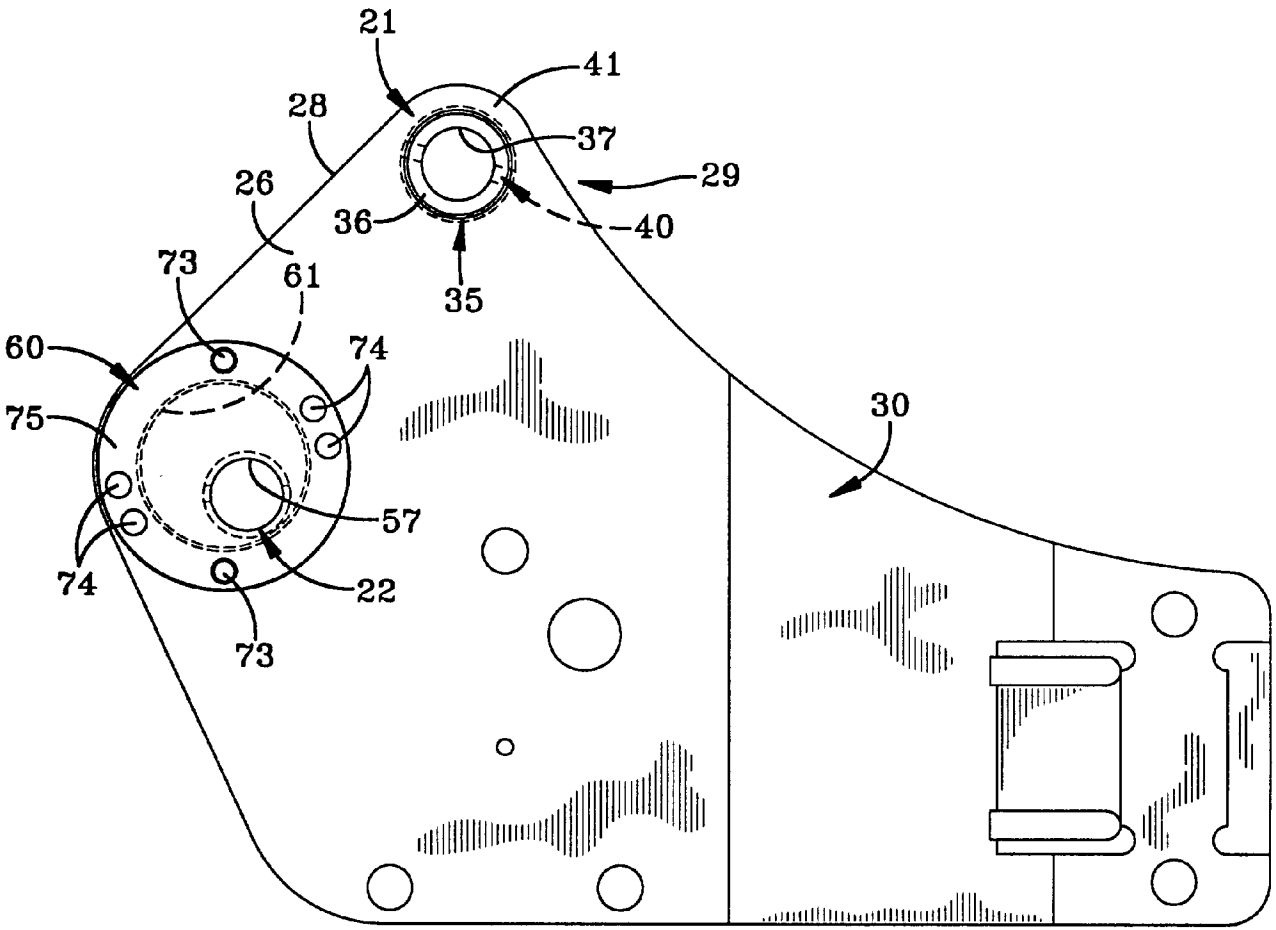
FIG. 2 is a side elevational view of the inside of one side plate in a connector assembly according to the present invention depicting further details of the connector assembly shown in FIG. 1.
Figure 3:
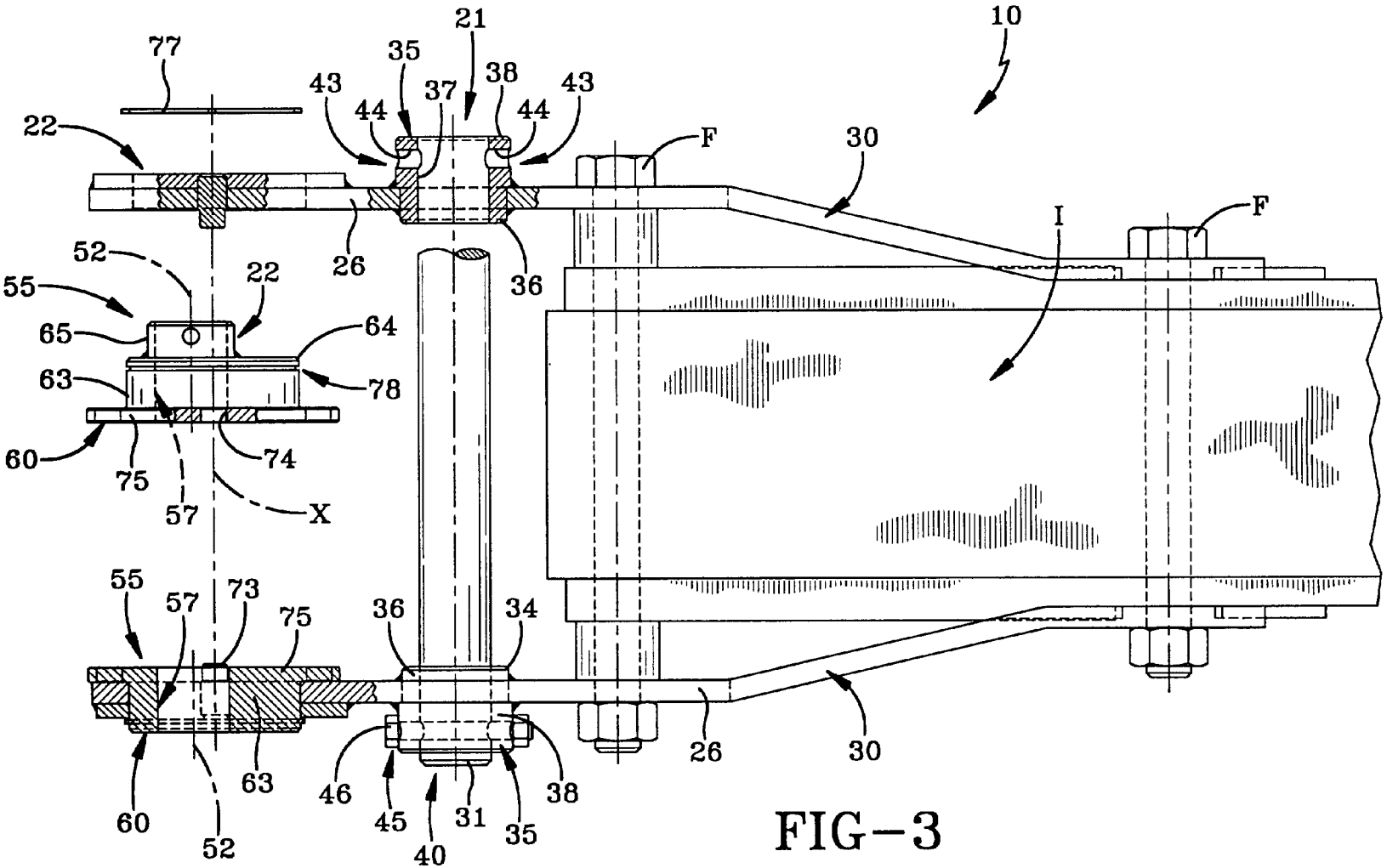
FIG. 3 is a top plan view of a connector assembly shown attached to an implement partially cut away to show additional details of the connector assembly shown in FIG. 1.

For example, as best shown in FIG. 2, the inboard end 27 of plates 26 may be provided with a generally planar edge 28 that generally spans a distance corresponding to the first and second receiving assemblies 21, 22. Side plates 26 may neck-inward at 29 adjacent first receiver 21 to provide operational clearance for the boom arm 12 or implement I. Extensions, generally indicated by the numeral 30 may extend from side plates 26 or form a part thereof to facilitate attachment of the plates 26 to an implement I, as by welds or fasteners F. If necessary, extensions 30, as shown in FIG. 3 may extend inwardly in the lateral direction to attach an implement I of smaller lateral dimension than side plates 26. It will be appreciated that other variations in the implement I may similarly be accommodated by extensions 30 or plates 26. While implement I is shown attached to connector assembly 10, it will be appreciated that connector assembly 10 may alternatively form an integral part of implement I.

Each side plate 26 carries first and second connecting pin receivers 21, 22 adapted to receive connecting pins 31, 32. Since the side plates 26 are of similar structure, for sake of simplicity, the receivers 21, 22 will be described with reference to only a single side plate 26, with similar structures on each plate identified by the same numeral in the Figures. In the example shown, only one pin receiver, in this case second pin receiver 22 is made adjustable. The remaining pin receiver 21 is fixed, but it will be appreciated that either or both of the pin receivers 21, 22 may be made adjustable, as described more completely below. According to the concepts of the present invention, the connector assembly 10 is provided with at least one adjustable pivot pin receiver 22, discussed in detail below, on a side plate 26. In the example shown, second receiver 22 is adjustable. The adjustable receiver 22 provides multiple relative pin spacings (FIG. 5) between the first and second pivot pin receivers 21, 22 on side plate 26. When only a single adjustable pin receiver is incorporated on side plate 26, movement is relative to a fixed connecting pin receiver. It will be appreciated, however, that both connecting pin receivers 21, 22 may be of the adjustable pin receiver type, such that adjustment may be made at either or both pivot pin receiving locations on the side plate 26.

Figure 1A:
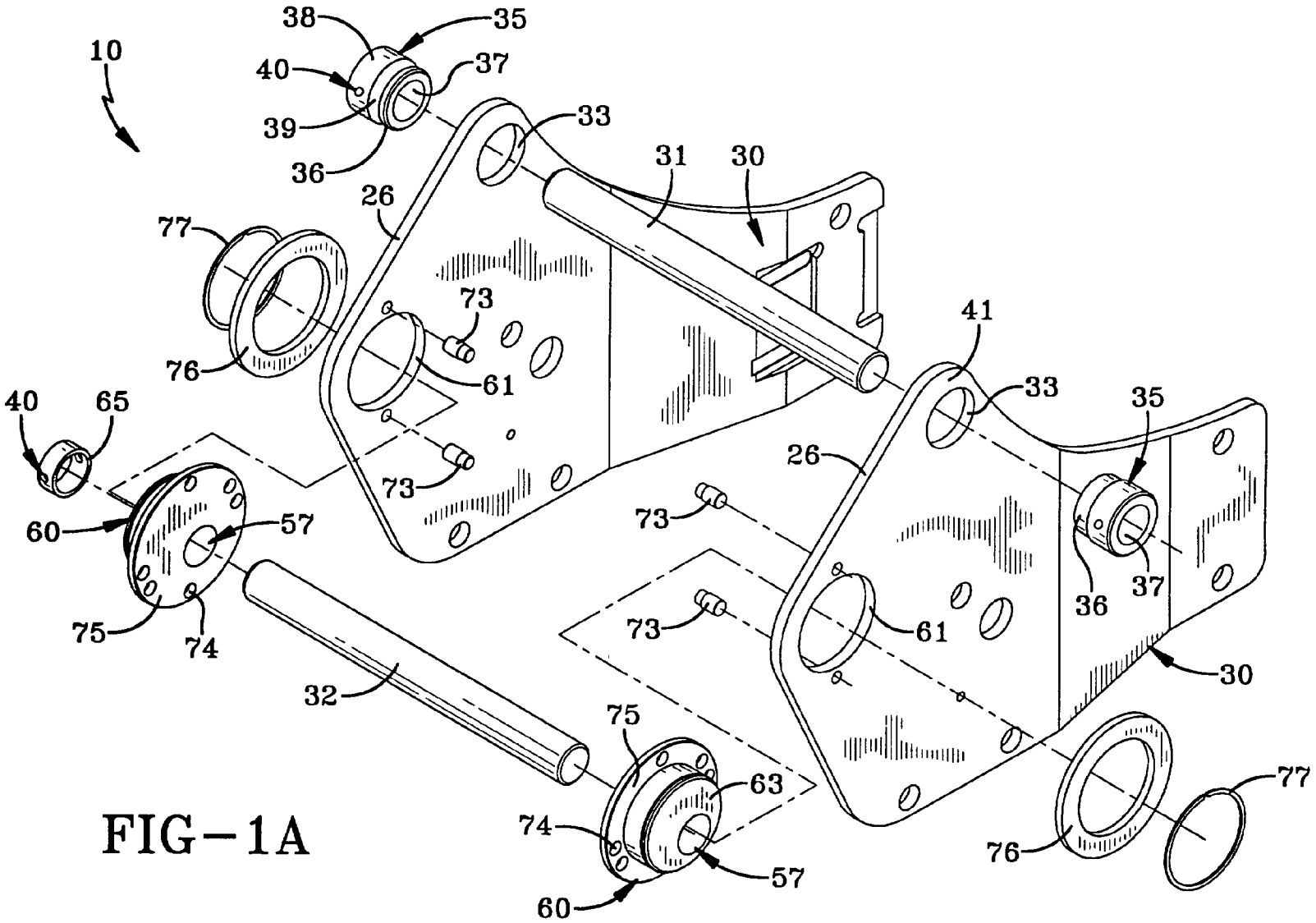
FIG. 1A is an exploded perspective view of a connector assembly depicting further details of the connector assembly shown in FIG. 1.

When using a single adjustable pin receiver, as shown, the first pin receiver 21 may be fixed on side plate 26 and be of a construction conventionally used in the connector art. For example, first pin receiver 21 may include a first transverse bore 33 sized to receive the first connecting pin 31. First pin receiver 21 may be fixed, and located nearest the prime mover 11. A reinforcing flange may extend axially outward of side plate 26 about the circumference of bore 33 to provide a reinforced thrust surface. Alternatively, first connecting pin receiver 21 may include a plug-like insert, generally indicated by the numeral 35, adapted to fit within the bore 33, which in this case would be sized and shaped to accommodate the insert 35. One such insert 35 is shown in FIG. 1A and generally includes an inset portion 36 adapted to fit within the bore 33 having a cylindrical inner surface defining a first pin receiving bore 37, sized to receive the first connecting pin 31, and a collar portion 38 extending radially outward from the inset portion defining a shoulder 39 that engages in the exterior lateral surface 41 of the side plate 26 in an axial manner. To facilitate insertion of insert 35 its leading edge 34 may be chamfered. Once inserted, insert 35 may be secured to the side plate 26, as by welds, as shown, or other fastening means common in the art.

A keeper assembly generally indicated by the numeral 40, in FIG. 3, may be provided on the side plate 26 or insert 35 to axially fix the connecting pin 31 once received within the first pin receiving bore 37. For example, as shown in FIG. 3, keeper assembly 40 may include a keeper receiver, generally indicated by the numeral 43, such as a pair of aligned keeper bores 44 opening into the pin bore 37 such that a keeper member, generally indicated by the numeral 45, such as a pin or bolt 46, may be inserted through the collar 38 and/or connecting pin 31 to axially couple the connecting pin 31 to each respective side plate 26.

Often manufacturers employ connecting pins 31, 32 of differing length and/or diameter relative to their competitors. To accommodate connecting pins 31,32 of varying length or diameter, the pin receivers 21, 22 may be adapted as by providing extensions or inserts, such as, additional bushings that extend to accommodate various pin lengths and decrease the diameter of the pin receiving bore 37.

Figure 5:
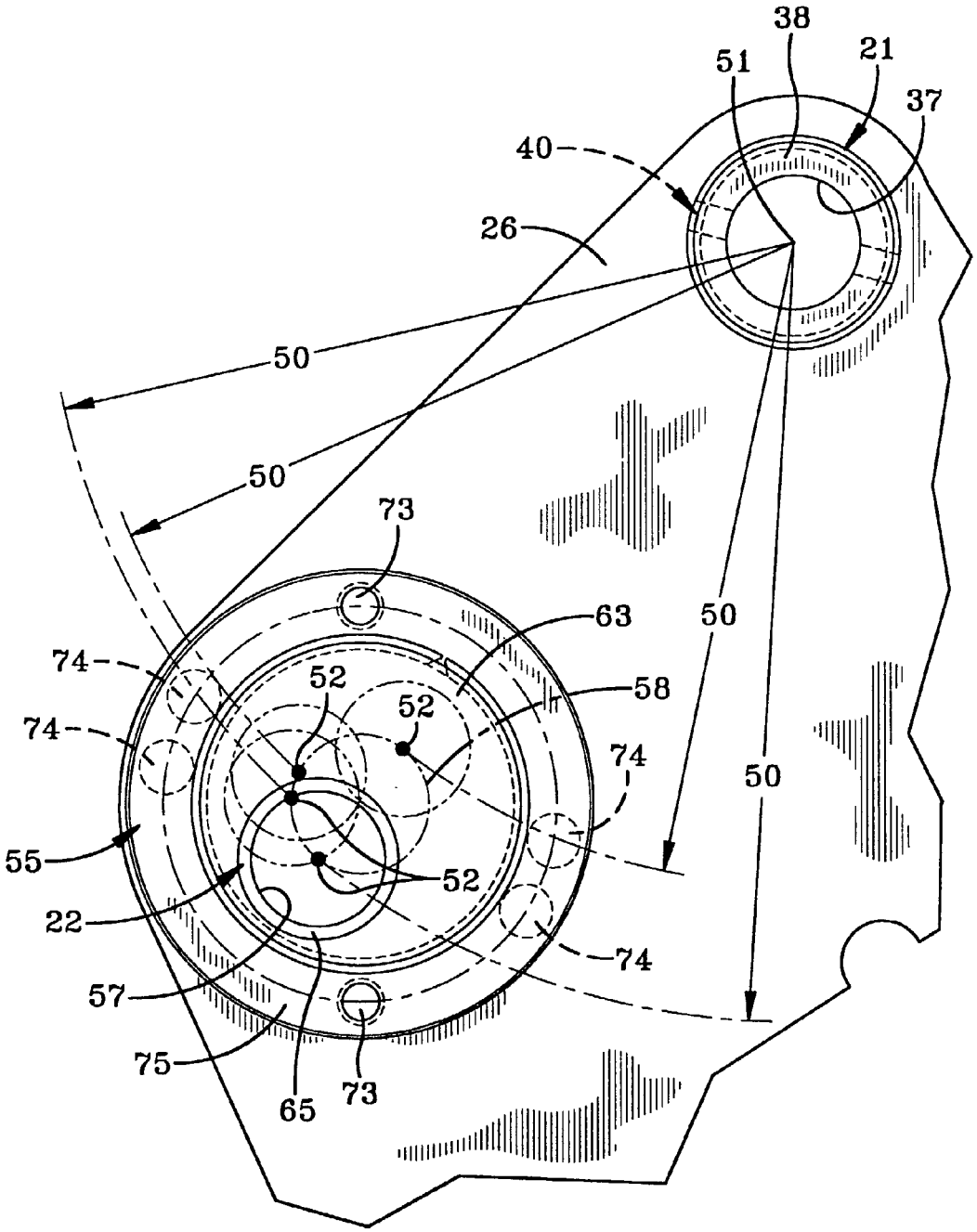
FIG. 5 is a fragmented partially schematic side elevational view of the connector assembly depicting one selected pin receiver spacing in solid lines and additional pin receiver spacings shown schematically in chain lines.

In addition to using connecting pins 31, 32 of various length and diameter, manufacturers employ unique pin spacings, generally indicated at 50 (FIG. 5) and measured as the distance between pin centers 51, 52 for purposes of this description, for the connection of implements I to the prime mover 11. As mentioned previously, one or both of the pin receiving assemblies 21, 22 may be made adjustable to account for relative spacings 50 of the first and second pivot pins 31, 32 required by a particular manufacturer. In the embodiment shown, the second pin receiving assembly 22, is an adjustable pin receiver. Second pin receiver 22 is spaced from the first pin receiving assembly 21 and provided with a second pin receiving bore 57 for the attachment of the implement I to prime mover 11. The second pin receiving bore 57, in this case, is spaced radially from an axis X and is made rotatable about this axis X to allow variation of the distance 50 between the first and second pin receiving bore centers 51, 52 effected by rotating bore center 52 about axis X. It will be appreciated that the configuration used to effect such rotation may be greatly varied and, thus, one form is not considered preferential over another. For example, the second pin receiver 22 may be located on a member, such as an arm attached adjacent side plate 20, that spaces the center 52 of the pin receiving bore 57 radially from the axis X, and is pivotally attached at axis X such that the second pin receiver 22 may be rotated to various angular positions along a circumferential path 58 (FIG. 5). The side plate 26 would then be provided with a suitable opening to accommodate the connecting pin 32 at multiple positions, such as a slot or multiple apertures corresponding to desired positions along the circumferential path 58 of the second pin receiver center 52, such as, spacings 50 corresponding to individual manufacturers.

Figure 4:
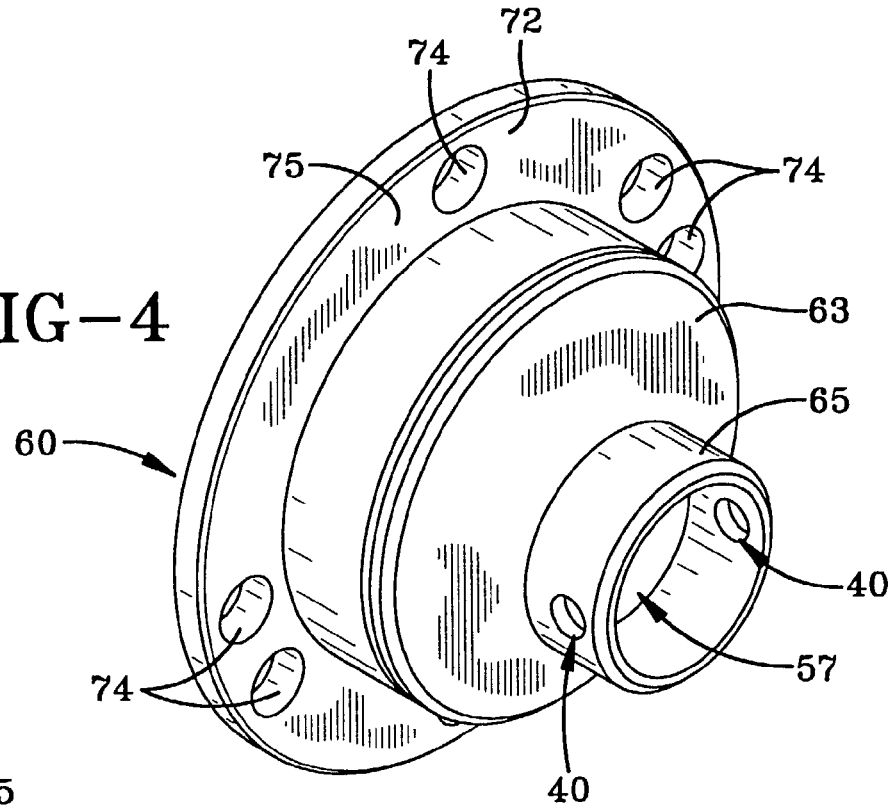
FIG. 4 is a perspective view of an adjustable pin receiver according to the present invention.
Figure 6:
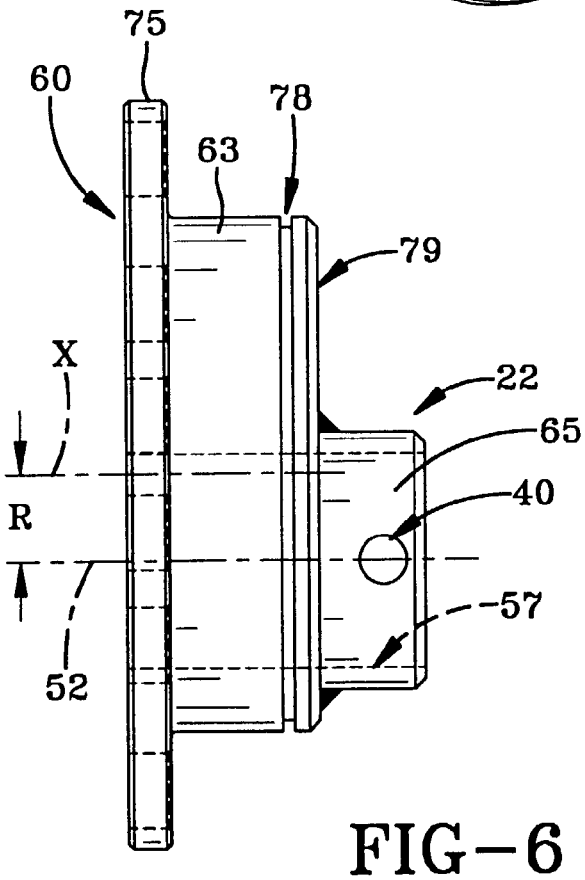
FIG. 6 is a front elevational view of an adjustable pin receiver according to the present invention.

Another possible adjustable pin receiver configuration, shown in the Figures, includes a hub assembly, generally indicated by the numeral 60 in FIGS. 4 and 6, which has a center corresponding to axis X, rotatably supported within a hub bore 61 (FIG. 1A) formed in side plate 26. Hub assembly 60 includes a cylindrical hub body 63 received within a circular hub bore 61 (FIG. 1A) defined by side plate 26 with sufficient clearance to allow relative rotation between the cylindrical hub body 63 and side plate 26. To facilitate rotation of the hub body 63, adjacent surfaces of the side plate 26 and hub 63 may be lubricated or suitable bearings may be used to reduce the friction therebetween. Hub assembly 60 may be provided with chamfered end 64 to facilitate installation of the hub body 63 through side plate 26. A circumferential groove 78 may be formed within the hub body 63 inward of the chamfered end 79 for the attachment of a lock ring 77 that axially fixes the hub body 63 within the hub bore 61. A washer 76 or other suitable thrust bearing member may be supported on the hub body 63 between the lock ring 77 and side plate 26, as shown in FIG. 1A.

The second pin receiving assembly 22 on hub assembly 60 may include a transverse bore 57 formed within the hub body 63 adapted to receive the second connecting pin 32, or pin receiving insert such as the insert 35 described above, may be used in conjunction with the hub assembly 60. In the embodiment shown, a collar 65 (FIG. 6) may be formed on or attached to the cylindrical hub body 63, as by welds as shown, and placed in registration with the second pin receiving bore 57 as shown in FIG. 5. Like insert 35, collar 65, may be provided with a keeper assembly 40 to axially fix the second connecting pin 32 within the second pin receiving bore 57. Also, as described above, suitable extensions or bushings may be used to adapt the receiving bore 57 to the given pivot pin's dimensions.

The second pin receiving bore 57 is adapted to receive the second pivot pin 32 and is spaced radially from the center of the hub body 63, which is located on the axis X, such that, rotation of the hub body 63 causes variation in the distance between the center 52 of second bore 57 and the center 51 of first bore 37. In this way, to account for the various spacings 50 by manufacturers, the hub body 63 may be rotated to increase or decrease the spacing 50, such that the second bore 57 assumes any position necessary for the spacing 50 of a selected manufacturer. Thus, connector assembly 10 provides for universal attachment of an implement I to a prime mover 11 in a single self contained system.

While a single radial spacing R of the second bore 57 from axis X is shown, it will be appreciated that this spacing R may be varied as necessary to adjust the length of the circumferential path 58. Once the desired pin spacing 50 is achieved, the connecting pins 31, 32 may be inserted through the pin receiving assemblies 21, 22 and the arms 15, 19 of the boom 12 and fixed therein by keepers 40. To lock the adjustable receiver 22 in a desired position, a locking assembly, generally indicated by the numeral 70, may be provided to selectively lock the hub body 63 in the desired position. In general, the locking assembly includes any means of rotatably fixing the hub body 63 relative to the side plate 26 including, clamping members, set pins, set screws, brake assemblies, or an actuator capable of maintaining the hub position. In the embodiment shown, for example, lock pins 73 extend from side plate 12 to be received within openings 74 formed on a lock pin receiver, generally indicated by the numeral 75, which may be a tab or annular flange 75, as shown. The radially extending flange 75, rests adjacent one side of the side plate 26, which, for example, may be the interior side, and is provided with lock pin receivers adapted to receive the lock pins and resist rotation of the hub assembly 60. In the embodiment shown, to provide reliable fixation of the hub, the locking assembly 70 includes a pair of diametrically opposed lock pins 73. Accordingly, the flange 75 includes one or more pairs of receivers 74 adapted to engage the lock pins 73. To provide multiple preset pin spacing positions, multiple pairs of receivers 74 are formed on the flange 75 such that the hub body 63 may be easily moved to another selected position by rotating the flange 75 until the desired pair of receivers 74 are aligned with the lock pins 73. Thus, as spacings 50 for different manufacturer's pins 31, 32 become known, additional receivers 21 may be machined into the flange 75 for purposes of defining preset locking positions. It will be appreciated that the position of the lock pins 73 and lock pin receivers 74 may be reversed such that the pins 73 extend from the flange 75 and the receivers 74 are formed in the side plate 26.

To move the hub body 63 between selected positions, the hub body 63 is moveable in the axial direction relative to the side plate 26, such that, in the example shown, hub body 63 is pushed inward until the lock pin 73, comes free of the lock pin receivers 74. With the lock pins 73 disengaged, the hub body 63 may be rotated to the next desired position. To engage the lock pins 73, the lock pins 73 and receiver 74 are aligned and hub body 63 are slid axially outward to re-engage the lock pins 73 and receivers 74 fixing the rotation of the hub body 63 at the newly selected position. A washer 76 and lock ring 77 or other suitable fasteners may be used to fix the axial position of the hub body 63 such that the lock pins 73 and/or the second connecting pin 32 are not inadvertently released during operation of the implement I. To accommodate the lock ring 77, the hub body 63 may be provided with an annular groove 78, which, as shown may be defined within the end 79 of the hub opposite the locking flange 75.

Figure 5A:
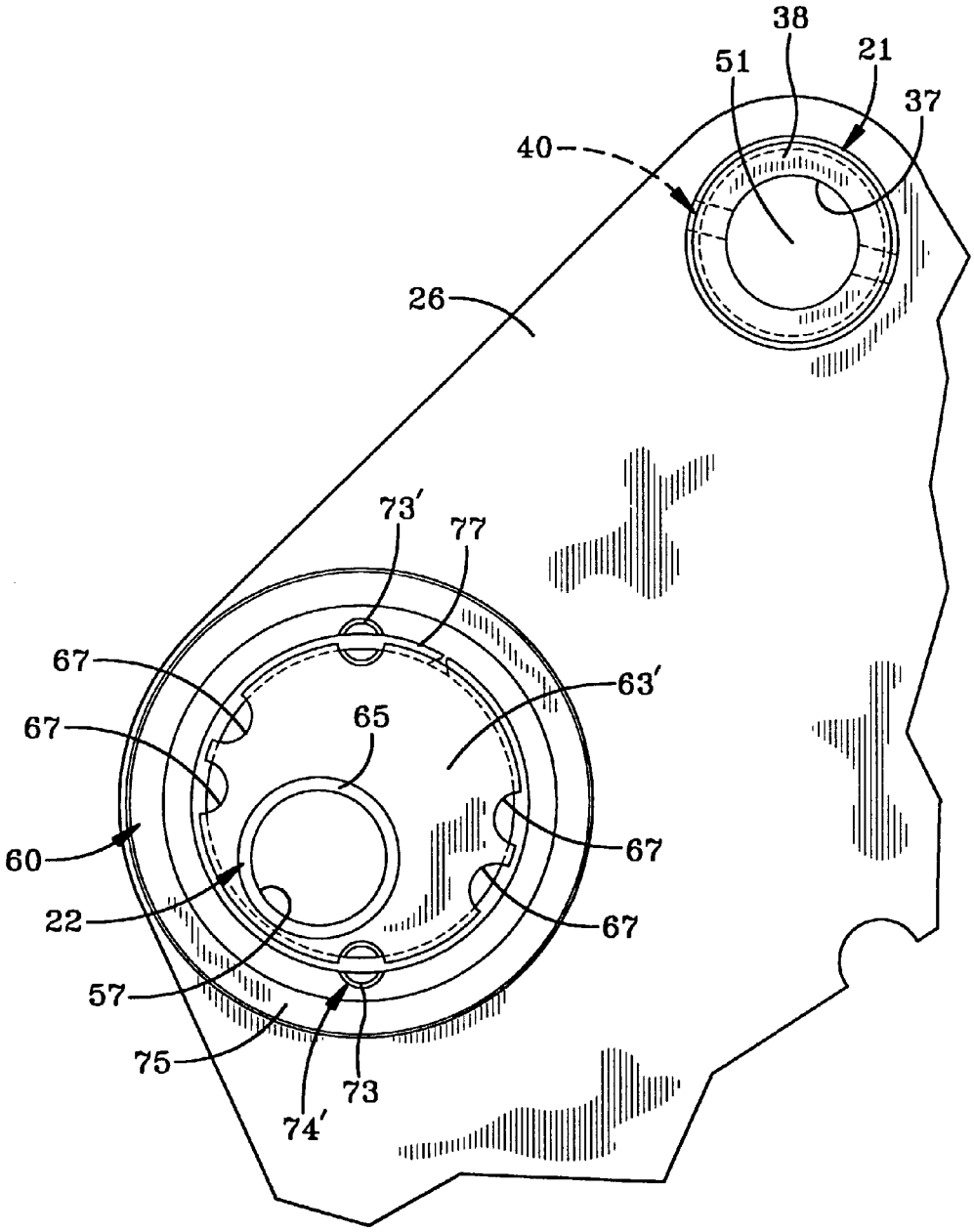
FIG. 5A is a fragmented side elevational view similar to FIG. 5 depicting an alternative adjustable receiver assembly.

Another locking assembly 70', is shown in FIG. 5A. The components of locking assembly 70' are similar to those in locking assembly 70, and, thus, like components bear the same reference numeral. As previewed above, variations in the components are indicated by attaching a prime (') to the common reference numeral. In assembly 70', semicircular notches 67 are formed in the hub body 63. A pair of lock pin receivers 74' are formed in the side plate 26. To hold the hub body 63 in a selected position, notches 67 are aligned with lock pin receivers 74', and the pin 73' inserted. The pin 73' may be secured within receiver 74' and notches 67, as by fasteners, interference fit, threads or the lock ring 77 shown. In the embodiment shown, pin 73' are sized such that they extend axially from receiver 74 to a point proximate groove 78, such that, when attached, lock ring 77 engages pin 73' to hold them in place.

FIG. 5 schematically depicts adjustment of the spacing 50 between first and second receivers 21, 22. As shown in FIG. 5, the connecting pin receiver center 52 may be located at any point on the circumferential path 58 defined by rotating hub body 63. Four possible second pin receiver locations identified by the numeral and letter combinations 52A, 52B, 52C, and 52D are shown as an example. Each location of bore center 52 may correspond to an individual prime mover or implement manufacturer. As previously discussed, multiple locking receivers 74 may be employed to define these preset positions. In this case, three pairs of locking pin receivers 74A, 74B, and 74C are used to define three pairs of center positions 52A, 52B, 52C. It will be appreciated that the location pairs include a first position for engagement of the lock pin 73 and receiver 74 and a second engaged position corresponding to a 180° rotation of the hub body 63 to align the same pins 73 and bore 74. As an example, center positions 52A and 52D correspond to positions obtainable using receivers 74A. Corresponding to each position is a relative spacing 50A, 50B, 50C and 50D of the first center 51 from the second center 52, as the second center 52 is rotated to any one of the center positions 52A, 52B, 52C or 52D. While these spacings 50 are shown as an example, any spacing 50 along the circumferential path 58 may be achieved, and, if necessary, the radial distance of the centers 52 from the axis X may be increased or decreased to accommodate larger or smaller pin spacings 50.

In operation, to change from one pin spacing 50 to another, for example, a move from pin spacing 50A to pin spacing 50B, the user would release the lock assembly 70, as by removing the lock ring 77, moving the hub body 63 axially to disengage the lock pins 73 from receiver 74A, then rotating the hub body 63 to align receivers 74B with lock pins 73, and relocking the hub assembly 60 by moving the hub body 63 axially to engage the lock pins 73 and lock pin receivers 74B. Once radially located, the hub body 63 may be axially locked, as by replacing the locking ring 73 to inhibit axial movement of the hub body 63. With the desired spacing set, the second pin 32 may be inserted through the second pin bore 57, the articulating arm 19, and the far second pin receiving bore 57 to complete attachment of implement I. At this point, the implement I is coupled at the pin spacing 50B, and keeper members 44 may be inserted in the keeper assembly 40 to axially fix the connecting pin 32. In this example, adjustment of the pin spacing 50 is made relative to a fixed first bore 21, but as previously discussed, first bore 21 could be made adjustable, in the manner of second pin receiving bore 22, such that, either or both of the pin receiving bores 21, 22 could be rotated to alter the spacing 50 between each other.

Figure 8:
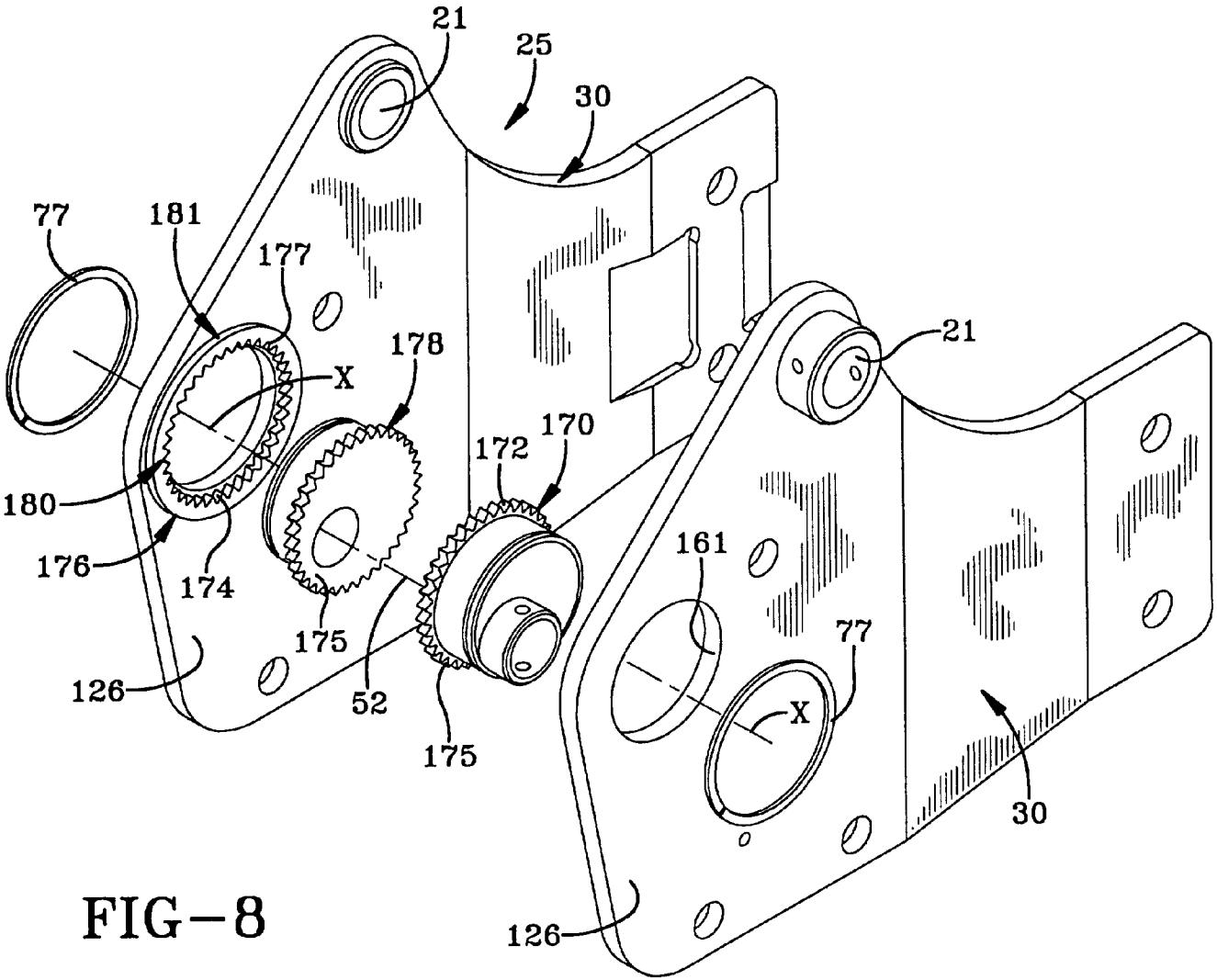
FIG. 8 is an exploded perspective view similar to that depicted in FIG. 1, of an alternative embodiment of a connector assembly having an alternative lock assembly.
Figure 9:
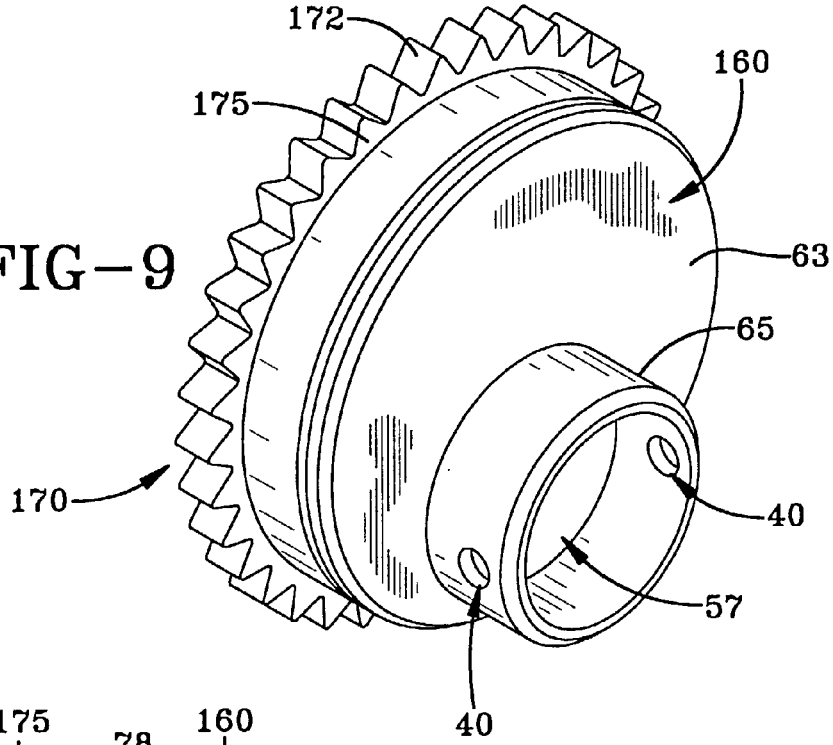
FIG. 9 is a perspective view of an alternative adjustable pin receiver according to the present invention depicting further details of the alternative lock assembly shown in FIG. 8.
Figure 10:
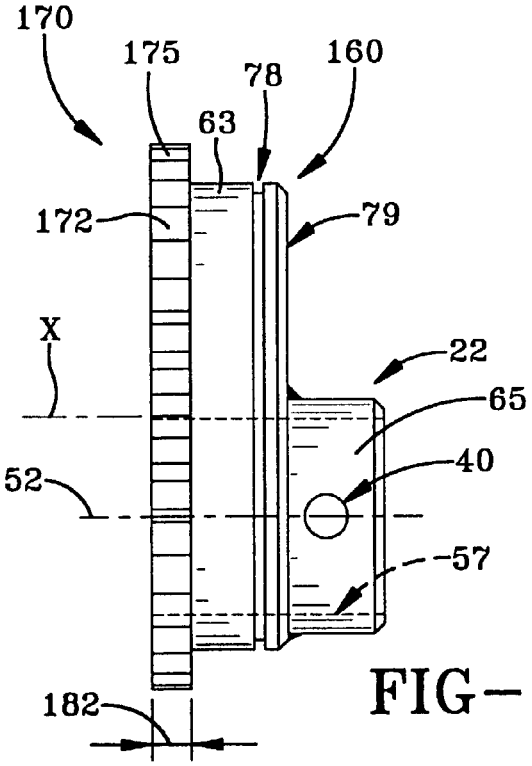
FIG. 10 is a front elevational view of the alternative adjustable pin receiver shown in FIG. 9.

An alternative connector assembly, generally indicated by the numeral 110 is shown in FIGS. 8–10. Since many of the components are shared with the previously described embodiment, like numerals will be used to refer to like components. For simplicity, only general reference will be made to components shared with the previously described connector assembly 10. For a more complete understanding of those components, reference may be made to the above description.

With reference to FIG. 8, an alternative locking assembly 170 is shown in connection with an adjustable receiver 22, described above, and generally includes at least one projection, for example, a tooth 172 adapted to engage a stop surface 174 to rotatably fix the adjustable receiver 22 in a selected position. In the example shown, a plurality of teeth 172 extend radially outward from the hub body 163 of hub assembly 160 forming a flange 175 having a corrugated locking periphery 178. As will be appreciated, teeth 172 may have generally any shape including, but not limited to, rounded, rectilinear, arcuate, or triangular, as shown. Corresponding locking member receivers, generally indicated by the numeral 176, such as notches 177 may be formed on the plate or a member attached thereto, to receive teeth 172. It will be appreciated that the location of the locking member and receiver structures 172, 176 may be reversed, for example, the flange 175 of hub assembly 60 may be provided with receivers to receive a locking member 172 extending from the side plate 26. In the example shown, the presence of a continuous row of teeth 172 about the periphery 178 of flange 175 and a corresponding receiver 176 having a continuous row of notches 177 adapted to receive teeth 172 and effectively create a side plate 126 and hub, 160 having both teeth and notches that interrelate to hold the hub assembly 60 in a selected position.

It will be appreciated that the locking member receiver 176 may be formed in the side plate 126. Optionally, to provide additional reinforcement, a raised gusset, generally indicated by the numeral 180, may extend axially outward from the side plate 126 to reinforce the portion surrounding the bore 161 formed in the side plate 126. As will be appreciated, the reinforcing gusset 180 may be located on either or both sides of the side plate 126. In the example shown, the locking member receiver 176 are formed in the gusset 180 such that the locking assembly 170 of hub 160 fits within the gusset 180. To provide a flush fit between the hub assembly 160 and the gusset 180, the thickness of the gusset, generally indicated at 181 may be made the same as the thickness, generally indicated at 182, of the flange 175. Alternatively, if gussets 180 having a greater thickness 181 than the flange 175 are used, the receiver 176 may extend into the gusset 180 to a depth equal to the thickness 182 of flange 175.

Operation of the alternative hub assembly 160 may be made in accordance with the above description, generally, the lock member 171 is disengaged from the stop surface 174, rotated to a selected position corresponding to the appropriate pin spacing 50 for a given implement I or prime mover 11. Once in the selected position, the hub 160 assembly is then engaged with locking assembly 170 to prevent rotation of the hub assembly 160. In the example depicted in FIG. 8, the locking assembly 170 is disengaged by moving the hub assembly 160 axially outward to remove the teeth 172 from the confines of the notches 177 in gusset 180. Once free from the notches 177, the hub assembly 160 may be rotated to the selected position. Then, to engage the lock assembly 170, the hub assembly is moved axially inward such that the teeth are inserted within the notches 177 preventing rotation of the hub assembly 160. As in the previous embodiment, to prevent axial movement of hub assembly 160, a suitable axial lock may be used, for example, lock ring 77. As will be appreciated, operation of the hub assembly 160 to adjust the spacing 50 between first bore 21 and second bore 22 may be made in the same manner as described in the previous embodiment.

It should now be apparent, that the present invention teaches a connector assembly embodying the concepts of the present invention that permits spacing of connecting pin receivers to adapt to unique pin spacings of various manufacturers.

The foregoing description of the exemplary embodiment of the invention has been presented for purposes of illustration and description. It is not intended to exhaust or limit the invention to the precise form disclosed. Modifications or variations are possible in light of the above teachings without departing from the scope and/or spirit of the invention. Therefore, for an appreciation of the scope of the invention, reference should be made to the following claims.

What is claimed is:

1. A connector assembly for coupling an implement to a prime mover by way of first and second connecting pins, the connector assembly comprising:

a first receiver adapted to receive one of said connecting pins and a second receiver adapted to receive the other of said connecting pins;

wherein said first receiver is rotatable eccentrically about an axis; and a locking assembly adapted to hold said first receiver in a selected spacing relative to said second receiver, said locking assembly including a locking member engageable with a stop surface to fix said receiver in said selected spacing wherein said stop surface defines a notch adapted to receive said locking member.

2. The connector assembly of claim 1, wherein said locking member includes a projection.

3. The connector assembly of claim 2, wherein said projection is in the form of a radially extending tooth.

4. The connector assembly of claim 1, wherein said locking member includes a plurality of radially extending circumferentially spaced teeth and wherein said stop surface defines a plurality of notches corresponding to said teeth.

5. A connector assembly for attaching an implement to a prime mover having spaced connecting pins, the connector assembly comprising:

a pair of spaced plates;

said plates defining a plurality of receivers adapted to receive the connecting pins;

wherein at least one of said receivers is mounted on a hub having an axis spaced from an axis of said receiver;

said hub being rotatable such that the receiver is rotatable about the axis of said hub; and a locking assembly carried on said hub to selectively rotationally fix said hub relative to said plate to define a selected spacing between said receivers wherein said locking member includes a plurality of radially extending teeth and said locking member receiver includes a plurality of notches adapted to receive said teeth.

6. The connector assembly of claim 5, wherein said hub includes radially extending flange, said teeth extending radially outward from said flange and wherein said side plate defines said notches.

7. The connector assembly of claim 5, wherein said teeth form a continuous row about a periphery of said flange, and wherein said side plate defines a continuous row of notches for receipt of said teeth.

* * * * *